US012467363B1

(12) United States Patent
Zhao et al.

(10) Patent No.: US 12,467,363 B1
(45) Date of Patent: Nov. 11, 2025

(54) DEVICE FOR REAL-TIME MONITORING MOVEMENT TRAJECTORY OF MINE ROOF STRATA AND METHOD THEREOF

(71) Applicants: SHANDONG UNIVERSITY OF SCIENCE AND TECHNOLOGY, Qingdao (CN); Shandong Energy Group Co., Ltd, Jinan (CN)

(72) Inventors: Tongbin Zhao, Qingdao (CN); Guowei Zhen, Qingdao (CN); Yanchun Yin, Qingdao (CN); Xiufeng Zhang, Qingdao (CN); Yang Chen, Qingdao (CN); Hui Cai, Qingdao (CN); Chunyu Dong, Qingdao (CN); Haiquan Liu, Qingdao (CN); Xuyou Wang, Qingdao (CN)

(73) Assignees: SHANDONG UNIVERSITY OF SCIENCE AND TECHNOLOGY, Qingdao (CN); Shandong Energy Group Co., Ltd, Jinan (CN)

( * ) Notice: Subject to any disclaimer, the term of this patent is extended or adjusted under 35 U.S.C. 154(b) by 0 days.

(21) Appl. No.: 18/892,431

(22) Filed: Sep. 22, 2024

Related U.S. Application Data

(63) Continuation of application No. PCT/CN2024/106637, filed on Jul. 22, 2024.

(30) Foreign Application Priority Data

May 9, 2024 (CN) ..... 202410569141.9

(51) Int. Cl.

| | |
|---|---|
| ***E21B 33/13*** | (2006.01) |
| ***E21D 11/15*** | (2006.01) |
| ***E21F 17/18*** | (2006.01) |

(52) U.S. Cl.
CPC ..... *E21F 17/185* (2013.01); *E21B 33/13* (2013.01); *E21D 11/152* (2013.01)

(58) Field of Classification Search
CPC ..... E21F 17/185; E21F 17/18; E21F 17/00; E21D 11/152; E21B 33/13
See application file for complete search history.

(56) References Cited

U.S. PATENT DOCUMENTS

| | | | | |
|---|---|---|---|---|
| 11,448,576 | B2 * | 9/2022 | Li | E21B 44/04 |
| 12,031,436 | B1 * | 7/2024 | Tian | E21C 39/00 |

(Continued)

FOREIGN PATENT DOCUMENTS

| | | | |
|---|---|---|---|
| CN | 101344012 | A | 1/2009 |
| CN | 205403743 | U | 7/2016 |

(Continued)

*Primary Examiner* — Daniel P Stephenson

(57) ABSTRACT

The present disclosure provides a device and a method for real-time monitoring the movement trajectory of mine roof strata, which relates to the technical field of the movement monitoring of mine roof strata. The device described in the present disclosure has fewer components, and the assembly process is simple and fast during use. It can be assembled and used according to the actual length of the monitoring borehole; the structure of the device is relatively simple, easy to manufacture, uses fewer precision instruments, and has a lower cost; by using the device of the present disclosure for real-time monitoring of mine roof strata, the movement trajectory of mine roof strata can be monitored in real-time, accurately, and continuously, providing more detailed strata information for disaster prevention and control such as mine pressure, strata control, and rock burst.

5 Claims, 2 Drawing Sheets

(56) References Cited

U.S. PATENT DOCUMENTS

| | | | | |
|---|---|---|---|---|
| 2016/0177676 | A1* | 6/2016 | Lynch | E21B 41/0035 405/285 |
| 2023/0296458 | A1 | 9/2023 | Liu et al. | |
| 2024/0378337 | A1* | 11/2024 | Yang | G06T 17/05 |

FOREIGN PATENT DOCUMENTS

| | | | | | |
|---|---|---|---|---|---|
| CN | 106840070 | A | | 6/2017 | |
| CN | 107165634 | A | | 9/2017 | |
| CN | 207036085 | U | | 2/2018 | |
| CN | 108590628 | A | | 9/2018 | |
| CN | 112344926 | A | | 2/2021 | |
| CN | 113863954 | A | | 12/2021 | |
| CN | 114294060 | A | | 4/2022 | |
| CN | 217681857 | U | | 10/2022 | |
| CN | 115265397 | A | | 11/2022 | |
| CN | 218327128 | U | | 1/2023 | |
| CN | 116044378 | A | | 5/2023 | |
| CN | 116771348 | A | | 9/2023 | |
| CN | 117211884 | A | | 12/2023 | |
| CN | 118481741 | B | * | 2/2025 | E21B 33/13 |
| EP | 2514916 | A2 | | 10/2012 | |
| KR | 101380208 | B1 | | 4/2014 | |
| WO | WO-2011103620 | A1 | * | 9/2011 | E21F 15/00 |
| WO | 2018082307 | A1 | | 5/2018 | |
| WO | WO-2021027292 | A1 | * | 2/2021 | E21D 21/0093 |
| WO | 2023201906 | A1 | | 10/2023 | |
| WO | WO-2024207790 | A1 | * | 10/2024 | E21F 17/00 |

* cited by examiner

DEVICE FOR REAL-TIME MONITORING MOVEMENT TRAJECTORY OF MINE ROOF STRATA AND METHOD THEREOF

CROSS-REFERENCE TO RELATED APPLICATIONS

This application is a continuation of International Application No. PCT/CN2024/106637 with a filling date of Jul. 22, 2024, designating the United states, now pending, and further claims to the benefit of priority from Chinese Application No. 202410569141.9 with a filing date of May 9, 2024. The content of the aforementioned applications, including any intervening amendments thereto, are incorporated herein by reference.

TECHNICAL FIELD

The present disclosure relates to the technical field of mine roof strata movement monitoring, in particular to a device for real-time monitoring movement trajectory of mine roof strata and a method thereof.

BACKGROUND

With the mining of the working face in coal mine underground, the roof of the goaf will fracture and collapse, and at the same time, it will cause the strata movement and the change of the stress field in stratum, and even cause major safety accidents such as rock burst, so it is very necessary to monitor the movement state of mine roof strata. At present, the monitoring methods for roof strata used in coal mines mainly include column type roof displacement sensor monitoring, borehole television peep monitoring, and double-end water plugging monitoring. For example, installing a column type roof displacement sensor in the filling goaf can fully monitor the subsidence speed and subsidence displacement of the roof strata in the filling goaf. The disadvantage is that the column type roof displacement sensor has high requirements for the stability of the bottom plate, communication lines, and equipment protection at the installation site, and is only suitable for monitoring the displacement of the surface of the roof strata in the filling goaf. The use of high-resolution borehole television peep to observe strata fractures has the advantages of simple operation and intuitive monitoring results, and is widely used in the fields of geological engineering and coal mine roof monitoring. However, it has the following disadvantages: the monitoring results are affected by the quality of the strata and the drilling effect, and the television probe is easily covered by sediment in the borehole or stuck by crushed stones in the borehole, resulting in poor imaging effect. In addition, the borehole television peep can only observe the development status of strata fractures at a certain moment, and cannot monitor the movement process of strata. The double-end water plugging method is to block a certain distance of the borehole with a blocker, and then inject water into that section of the borehole. The degree of fracture development and the height of the fracture zone in the strata are determined by the water loss of the injected water in the blocked section of the borehole. The disadvantage is that the depth of the borehole is large, the measurement data is not accurate enough, and the measurement efficiency is low. The above monitoring methods all have certain limitations, they can only detect the degree of fracture development in the roof strata and monitor the fracture status of the strata, and cannot effectively obtain the full process information of the specific structure and movement of strata.

SUMMARY

The objective of the present disclosure is to provide a device and a method for real-time monitoring the movement trajectory of mine roof strata, which can monitor the movement trajectory of mine roof strata in real-time, accurately, and continuously.

In order to achieve the above objective, the technical solution adopted by the present disclosure is as follows:

A device for real-time monitoring a movement trajectory of mine roof strata, including supporting pipes, connecting pipes, a displacement sensor, an angle sensor, a hole sealing ring, a grouting main pipe, a grouting branch pipe, a grouting unit, and a data acquisition unit;

The supporting pipes are made of hard materials, the connecting pipes are made of soft materials, and the connecting pipes are capable of being compressed, extended, or bent by an external force;

A plurality of supporting pipes are connected end-to-end in sequence, and two adjacent supporting pipes are connected to each other by the connecting pipes;

Between two adjacent supporting pipes, at least one of the supporting pipes is provided with the displacement sensor for measuring a distance between two adjacent supporting pipes;

One angle sensor is arranged in each of the supporting pipes, and the angle sensor is used to measure the angle of the supporting pipe where the angle sensor is located;

At least one hole sealing ring is arranged in the circumferential direction of a head end and a tail end of each of the supporting pipes;

A grouting main pipe passes through interiors of each of supporting pipes and connecting pipes, at least one grouting branch pipe is installed inside each of the supporting pipes, one end of the grouting branch pipe is communicated with the grouting main pipe, an other end of the grouting branch pipe is exposed from a side wall of the supporting pipe, and the other end of the grouting branch pipe is located between two hole sealing rings;

A grouting unit is connected to the grouting main pipe for injecting grout into the grouting main pipe;

A data acquisition unit is in signal connection to the displacement sensor and the angle sensor for collecting distance and angle data.

A method for real-time monitoring the movement trajectory of mine roof strata, applying the device for real-time monitoring the movement trajectory of mine roof strata mentioned above, wherein the method includes the following steps:

Step 1, drilling a hole in a roof strata of a roadway or a working face to form a monitoring borehole;

Step 2, pushing the sequentially connected support pipes and connecting pipes into the monitoring borehole, and the hole sealing ring is attached to the supporting pipes and an inner wall of the monitoring borehole;

Step 3, injecting grout from the grouting unit into the grouting main pipe and the grouting branch pipe, the grout flows to the supporting pipes, the inner wall of the monitoring borehole, and a space between two the hole sealing rings.

Step 4, after the grout solidifies, collecting, by the data acquisition unit, a distance data measured by the displacement sensor and an angle data measured by the angle sensor in real time, and then obtaining a horizontal position and a vertical position of any of the supporting pipes in real-time, and depicting the movement trajectory of roof strata based on the real-time horizontal position and the vertical position of each of the supporting pipes in real-time.

The the advantageous effects of the present disclosure are:

The device of the present disclosure has fewer components, and the assembly process during on-site use is simple and rapid. It can be assembled and used in mine roof monitoring according to the actual length of the monitoring borehole;

The device of the present disclosure has a relatively simple structure, is easy to process and manufacture, and uses fewer precision instruments inside. The overall cost of the device is relatively low, which can reduce the investment cost of mine monitoring;

By applying the device of the present disclosure, real-time monitoring of mine roof strata can be achieved, so as to realize the accurate and continuous monitoring of the movement trajectory of mine roof strata in real-time, which can provide more detailed strata information for disaster prevention and control such as mine pressure, strata control, and rock burst.

DETAILED DESCRIPTION OF THE EMBODIMENTS

Figure 1:
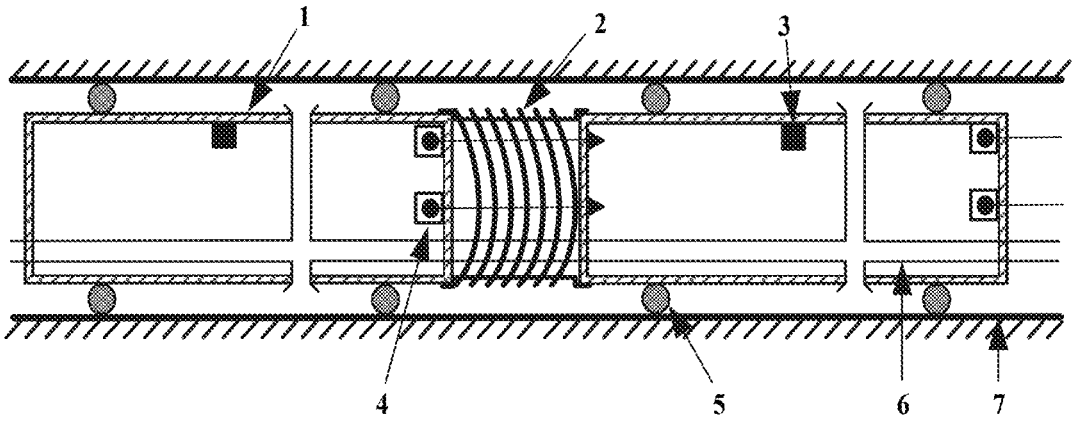
FIG. 1 is a schematic structural diagram of a device for real-time monitoring the movement trajectory of mine roof strata in the embodiment of the present disclosure.

The present invention will be further described with reference to the drawings and preferred embodiments. It should be understood that these embodiments are only used to illustrate the present invention, but the present invention is not limited thereto. In addition, it should be understood that after reading the content described in the present invention, those skilled in the art can make various changes or modifications to the present invention, and these equivalent technical means also fall within the scope of protection of the present invention.

In the present invention, the terms "first," "second," and "third" are merely for the purpose of description, but cannot be understood as indicating or implying relative importance. The term "multiple" means two or more unless otherwise explicitly defined. The terms "mount," "connect with," "connect," "fix," and the like shall be understood in a broad sense. For example, "connect" may mean being fixedly connected, detachably connected, or integrally connected; and "connect with" may mean being directly connected or indirectly connected through an intermediary. For those of ordinary skill in the art, specific meanings of the above terms in the present invention can be understood according to specific situations.

In the description of the present invention, it should be understood that if orientation or position relations indicated by the terms such as "upper," "lower," "inside," "outside," "front," "back," and the like are based on the orientation or position relations shown in the drawings, and the terms are intended only to facilitate the description of the present invention and simplify the description, rather than indicating or implying that the apparatus or element referred to must have a particular orientation and be constructed and operated in the particular orientation, and therefore cannot be construed as a limitation on the present invention.

Figure 2:
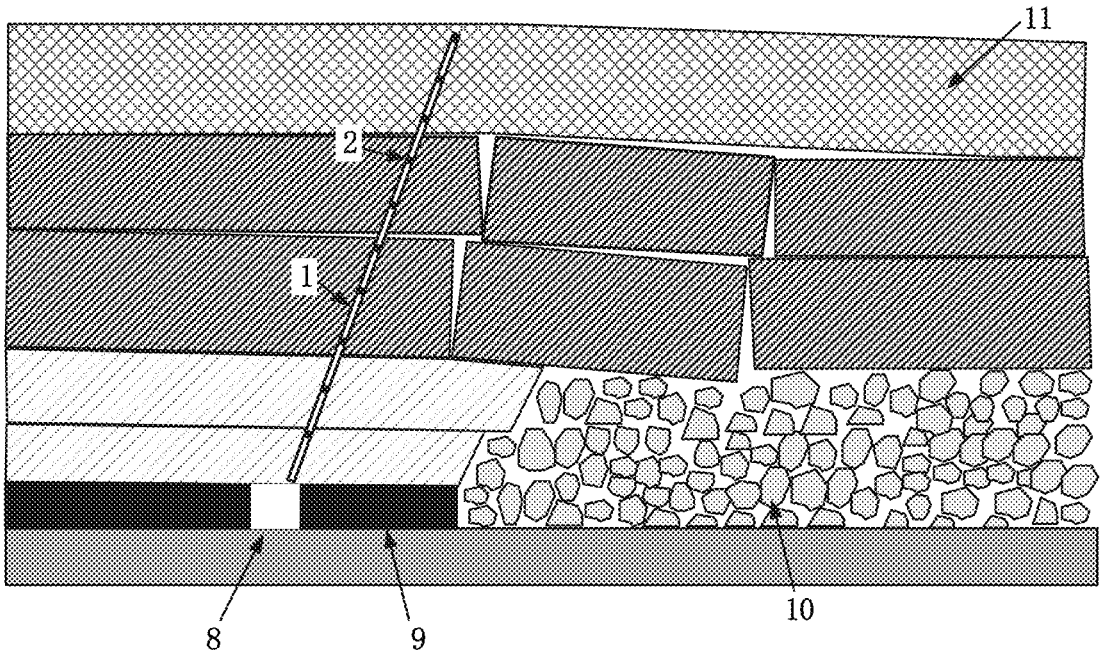
FIG. 2 is a schematic diagram of the construction layout of the device for real-time monitoring the movement trajectory of mine roof strata in the embodiment of the present disclosure.
Figure 3:
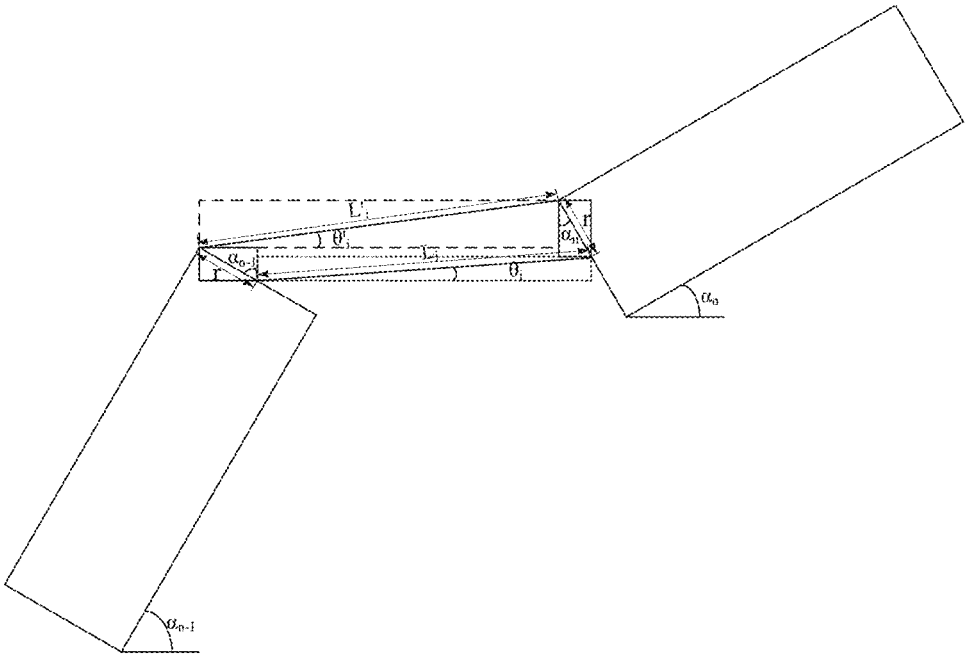
FIG. 3 is a schematic diagram of the calculation principle for measuring the distance between adjacent supporting pipes using a displacement sensor in the embodiment of the present disclosure.
Figure 4:
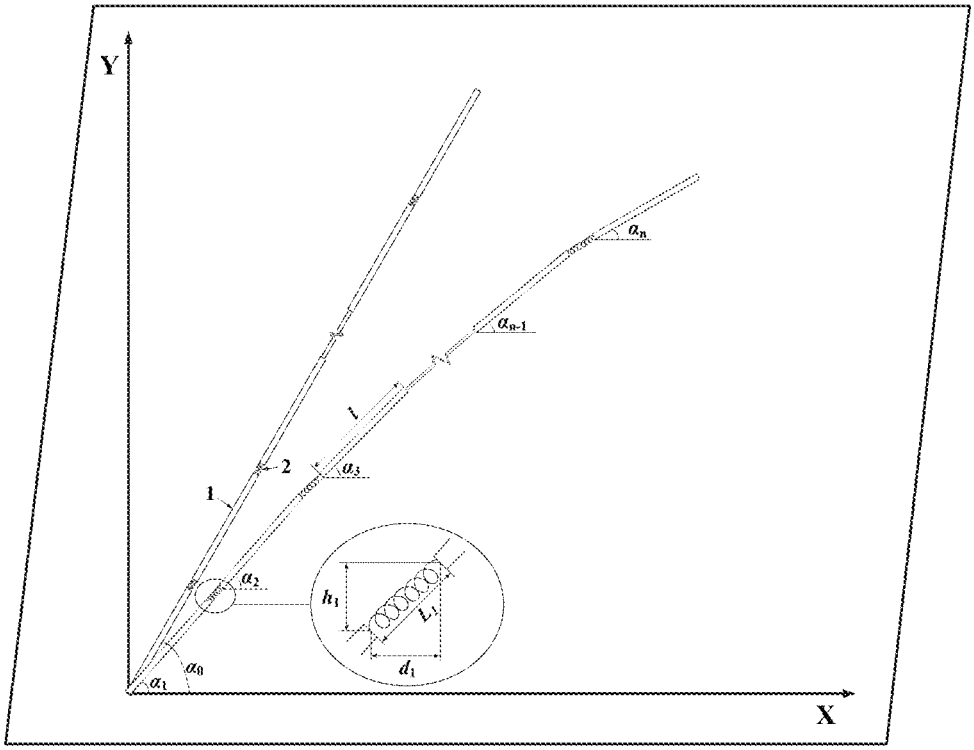
FIG. 4 is a schematic diagram of the movement trajectory of the supporting pipe in the embodiment of the present disclosure.

In the embodiments of the present disclosure, a device and a method for real-time monitoring the movement trajectory of mine roof strata are provided, as shown in FIG. 1 to FIG. 4.

A device for real-time monitoring the movement trajectory of mine roof strata includes supporting pipes 1, connecting pipes 2, a displacement sensor 4, an angle sensor 3, a hole sealing ring 5, a grouting main pipe 6, a grouting branch pipe, a grouting unit, and a data acquisition unit.

The supporting pipe 1 is made of hard material, and both ends of the supporting pipe 1 is closed. The connecting pipe 2 is made of soft material and can be compressed, extended, or bent by an external force. Wherein the length of the supporting pipe 1 is 40 cm, the minimum length of the connecting pipe 2 after compression is 8 cm, and the maximum length after extension is 25 cm.

A plurality of supporting pipes 1 are connected end-to-end in sequence, and two adjacent supporting pipes 1 are connected to each other by a connecting pipe 2.

Between two adjacent supporting pipes 1, at least one supporting pipe 1 is provided with a displacement sensor 4 for measuring the distance between two adjacent supporting pipes 1.

The displacement sensor 4 uses a draw-wire displacement sensor, and at least one draw-wire displacement sensor is arranged between adjacent supporting pipes 1. The main body end of the draw-wire displacement sensor is connected to the head end of one of the two adjacent supporting pipes 1, and the rope end of the draw-wire displacement sensor is connected to the tail end of the other one of the two adjacent supporting pipes 1.

Specifically, two draw-wire displacement sensors are arranged between adjacent supporting pipe 1. The main body end of one of the two draw-wire displacement sensor is connected to the axis position of the head end of one of the two adjacent supporting pipe 1, and a rope end of the rope displacement sensor is connected to the axis position of the tail end of the other adjacent supporting pipe 1. The main body end of the other rope displacement sensor is connected to the upper edge position of the head end of the adjacent supporting pipe 1, and the rope end of the other rope displacement sensor is connected to the upper edge position of the tail end of the other adjacent supporting pipe 1.

One angle sensor 3 is arranged in each supporting pipe 1, and the angle sensor 3 is used to measure the angle of the supporting pipe 1 where the angle sensor 3 is located, which is the included angle between the axis of the supporting pipe 1 and the horizontal line.

An hole sealing ring 5 is arranged in the circumferential direction of the head end and the tail end of each supporting pipe 1. Wherein the hole sealing ring 5 is made of soft material (rubber), so that the hole sealing ring 5 is closely attached to the supporting pipe 1 and the inner wall of the monitoring borehole 7. By sealing connection between the supporting pipe 1 and the inner wall of the monitoring borehole 7 with the hole sealing ring 5, an unenclosed space is formed between the supporting pipe 1, the inner wall of the monitoring borehole 7, and two the hole sealing rings 5.

The grouting main pipe 6 passes through the interiors of each supporting pipe 1 and each connecting pipe 2, and two grouting branch pipes are arranged inside each supporting pipe 1. The two grouting branch pipes are arranged coaxially, and the grouting branch pipes are arranged perpendicular to the grouting main pipe 6. One end of the grouting branch pipe is communicated with the grouting main pipe 6, the other end of the grouting branch pipe is exposed from the side wall of the supporting pipe 1, and located between two hole sealing rings 5.

The grouting unit is located in the gob-side entry 8, and is connected to the grouting main pipe 6 for injecting grout into the grouting main pipe 6 and the grouting branch pipe. When injecting grout into the grouting main pipe 6 and the grouting branch pipe by the grouting unit, the grout enters the enclosed space from the grouting branch pipe. After the grout solidifies, the grout fixes the supporting pipe 1 and the roof strata as a whole. In this way, the supporting pipe 1 can migrate and rotate along with the roof strata. Wherein two hole sealing rings 5 are used to confine the grout to the enclosed space on the circumferential outside of the supporting pipe 1, avoiding the grout from flowing to the position between adjacent supporting pipe 1, thereby preventing the connecting pipe 2 from being compressed, extended or bent caused by the grout solidification.

The data acquisition unit is located in the gob-side entry 8, and the data acquisition unit is in signal connection with each displacement sensor 4 and each angle sensor 3, and is used for collecting distance data through the displacement sensor 4 and collecting angle data through the angle sensor 3. Wherein the data acquisition unit is capable of being connected to each displacement sensor 4 and each angle sensor 3 through signal cables, signal cables pass through the supporting pipe 1 and the connecting pipe 2.

The grouting branch pipe is connected to the supporting pipe 1 through a plastic buckle, and under external force, the buckle can disengage from the supporting pipe 1. In this way, when it is necessary to remove the grouting main pipe 6 from the monitoring borehole 7, simply pull the grouting main pipe 6 outside the monitoring borehole 7 to detach the grouting main pipe 6 and the grouting branch pipe from the supporting pipe 1. This prevents the grouting main 6 from solidifying inside the supporting pipe 1 and the connecting pipe 2, and prevents the solidified grouting main pipe 6 from damaging the angle sensor 3 or the displacement sensor 4 during migration and rotation of the roof strata.

A method for real-time monitoring the movement trajectory of mine roof strata, applying the device for real-time monitoring the movement trajectory of mine roof strata described in this embodiment, wherein the method including the following steps:

Step 1: setting a coal column 9 on one side of the goaf 10 and setting a gob-side entry 8. Drilling holes in the goaf 10 or the roof strata of solid coal of the gob-side entry 8 or the top of working face to form monitoring borehole 7, and the drilling depth should reach key stratum 11.

Step 2: determining the length of the connection between the supporting pipe 1 and the connecting pipe 2 based on the depth of the monitoring borehole 7. Pushing the supporting pipe 1 and the connecting pipe 2 connected in sequence into the monitoring borehole 7, and the hole sealing ring 5 is attached to the supporting pipe 1 and the inner wall of the monitoring borehole 7.

Step 3: injecting grout from the grouting unit into the grouting main pipe 6 and the grouting branch pipe. The grout flows to the supporting pipe 1, the inner wall of the monitoring borehole 7, and the space between two the hole sealing rings 5. After the grouting is completed and before the grout solidifies, the grouting main pipe 6 is removed from the monitoring borehole 7.

Step 4: After the grout solidifies, the data acquisition unit collects the distance data measured by the displacement sensor 4 and the angle data measured by the angle sensor 3 in real time, and then obtains the real-time horizontal position and vertical position of any supporting pipe 1, and depicts the movement trajectory of roof strata by the real-time horizontal and vertical positions of each supporting pipe 1.

In the step 4,

The calculation formula for the horizontal position $X_n$ of any supporting pipe 1 is:

$$X_n = I\cos\alpha_1 + d_1 + I\cos\alpha_2 + d_2 \ \ldots \ + d_{(n-1)} + \frac{1}{2}I\cos\alpha_n;$$

In the formula:

l—the length of the supporting pipe 1, in cm;

$\alpha_1$—the angle of the first supporting pipe 1 measured by the angle sensor 3, in degrees;

$\alpha_2$—the angle of the second supporting pipe 1 measured by the angle sensor 3, in degrees;

$\alpha_n$—the angle of the nth supporting pipe 1 measured by the angle sensor 3, in degrees;

$d_1$—the projection value of the distance between the first supporting pipe 1 and the second supporting pipe 1 in the X direction measured by the displacement sensor 4, in cm;

$d_2$—the projection value of the distance between the second supporting pipe 1 and the third supporting pipe 1 in the X direction measured by the displacement sensor 4, in cm;

$d_{(n-1)}$—the projection value of the distance between the (n−1)th supporting pipe 1 and the nth supporting pipe 1 measured by the displacement sensor 4 in the X direction, in cm;

The calculation formula for the vertical position of any supporting pipe 1 is:

$$Y_n = I\sin\alpha_1 + h_1 + I\sin\alpha_2 + h_2 \ \ldots \ + h_{(n-1)} + \frac{1}{2}I\sin\alpha_n;$$

l—the length of the supporting pipe 1, in cm;

$\alpha_1$—the angle of the first supporting pipe 1 measured by the angle sensor 3, in degrees;

$\alpha_2$—the angle of the second supporting pipe 1 measured by the angle sensor 3, in degrees;

$\alpha_n$—the angle of the nth supporting pipe 1 measured by the angle sensor 3, in degrees;

$h_1$—the projection value of the distance between the first supporting pipe 1 and the second supporting pipe 1 in the Y direction measured by the displacement sensor 4, in cm;

$h_2$—the projection value of the distance between the second supporting pipe 1 and the third supporting pipe 1 in the Y direction measured by the displacement sensor 4, in cm;

$h_{(n-1)}$—the projection value of the distance between the (n−1)th supporting pipe 1 and the nth supporting pipe 1 in the Y direction measured by the displacement sensor 4, in cm.

Wherein, the specific calculation method for the relative position of adjacent supporting pipes 1 is:

The specifications and dimensions of each supporting pipe 1 are the same. The angles of the supporting pipe i and the supporting pipe i+1 are measured by the angle sensor 3 as $\alpha_{n-1}$ and $\alpha_n$, and the radius of the supporting pipe 1 is r, as well as the distance between the supporting pipe i and the supporting pipe i+1 as $L_i$ and $L'_i$. Wherein the distance $L_i$ is measured by the draw-wire displacement sensor 4 connected the axial positions of the head end and the tail end of adjacent supporting pipes 1, and the distance $L'_i$ is measured by the draw-wire displacement sensor 4 connected the upper edge positions of the head end and the tail end of adjacent supporting pipes 1.

Assuming that the angles between two the draw-wire displacement sensors 4 and the horizontal direction are $\theta_i$ and $\theta'_i$, respectively, draw rectangles with the radii of the supporting pipe i and the supporting pipe i+1 and the ropes of two the draw-wire displacement sensors 4 as diagonals. According to the geometric relationship and trigonometric function relationship, the following formula can be obtain:

$$r \cos \alpha_n - L'_i \sin \theta'_i = r \cos \alpha_{n-1} - L_i \sin \theta_i;$$

$$L'_i \cos \theta'_i - r \sin \alpha_{n-1} = L_i \cos \theta_i - r \sin \alpha_n;$$

Wherein r—the radius of the supporting pipe 1, in cm;

$L_i$—the length of the rope measured by the draw-wire displacement sensor 4 connected the axial positions of the head end and the tail end of adjacent supporting pipes 1, in cm;

$L'_i$—the length of the rope measured by the draw-wire displacement sensor 4 connected the upper edge positions of the head end and the tail end of adjacent supporting pipes 1, in cm;

$\alpha_{n-1}$—the angle of the (n−1)th supporting pipe 1, in degrees;

$\alpha_n$—the angle of the nth supporting pipe 1, in degrees;

$\theta_i$—the angle between the rope of the draw-wire displacement sensor 4 connected the axis position of the head end and tail end of the (n−1)th supporting pipe 1 and the nth supporting pipe 1, and the horizontal direction, in degrees;

$\theta'_i$—the angle between the rope of the draw-wire displacement sensor 4 connected to the upper edge position of the head end and the tail end of the (n−1)th supporting pipe 1 and the nth supporting pipe 1, and the horizontal direction, in degrees;

According to the above two formulas, the angle $\theta_i$ and $\theta'_i$ between the horizontal direction and the rope of the draw-wire displacement sensor 4 between the supporting pipe i and the supporting pipe i+1 can be obtained.

So it can further obtain the following:

The calculation formula for the projection value $d_{(n-1)}$ of the distance between the (n−1)th supporting pipe 1 and the nth supporting pipe 1 in the X direction is:

$$d_{(n-1)} = L_i \cos \theta_i;$$

The calculation formula for the projection value $h_{(n-1)}$ of the distance between the (n−1)th supporting pipe 1 and the nth supporting pipe 1 in the Y direction is:

$$h_{(n-1)} = L_i \sin \theta_i.$$

Thus, a detailed description of the embodiment has been provided in conjunction with the accompanying drawings. Based on the above description, technical personnel in this field should have a clear understanding of the device and the method for real-time monitoring the movement trajectory of mine roof strata of the present disclosure. The device for real-time monitoring the movement trajectory of mine roof strata of the present disclosure has fewer components, and the assembly process is simple and rapid during on-site use. It can be assembled and used according to the actual length of the monitoring borehole 7 in mining roof monitoring. The device for real-time monitoring the movement trajectory of mine roof strata of the present disclosure has a relatively simple structure, which is easy to process and manufacture, and uses fewer precision instruments inside. The precise instruments only include the angle sensor 3 and the displacement sensor 4, so that the overall cost of the device is relatively low, which can reduce the investment cost of mining monitoring. The device for real-time monitoring the movement trajectory of mine roof strata of the present disclosure is applied to monitor the mine roof strata in real time, the movement trajectory of mine roof strata can be monitored in real time, accurately and continuously, and more detailed strata information can be provided for disaster prevention and control such as mine pressure, strata control and rock burst.

Certainly, the above descriptions are merely preferred embodiments of the present disclosure. The present disclosure is not limited to the above embodiments listed. It should be noted that, all equivalent replacements and obvious variations made by any person skilled in the art under the teaching of the specification fall within the essential scope of the specification and shall be protected by the present disclosure.

What is claimed is:

1. A device for real-time monitoring a movement trajectory of mine roof strata, comprising supporting pipes, connecting pipes, a displacement sensor, an angle sensor, a hole sealing ring, a grouting main pipe, a grouting branch pipe, a grouting unit, and a data acquisition unit;

the supporting pipes are made of hard materials, the connecting pipes are made of soft materials and the connecting pipes are capable of being compressed, extended, or bent by an external force;

a plurality of supporting pipes are connected end-to-end in sequence, and two adjacent supporting pipes are connected to each other by the connecting pipes;

between two adjacent supporting pipes, at least one of the supporting pipes is provided with the displacement sensor for measuring a distance between two adjacent supporting pipes;

each of the supporting pipes is provided with one angle sensor, and the angle sensor is used to measure an angle of each of the supporting pipes where the angle sensor is located;

at least one hole sealing ring is arranged in a circumferential direction of a head end and a tail end of each of the supporting pipes;

a grouting main pipe passes through an interior of each of the supporting pipes and the connecting pipes, at least one grouting branch pipe is installed inside each of the supporting pipes, one end of the grouting branch pipe is communicated with the grouting main pipe, an other end of the grouting branch pipe is exposed from a side wall of the supporting pipe, and the other end of the grouting branch pipe is located between two hole sealing rings;

a grouting unit is connected to the grouting main pipe for injecting grout into the grouting main pipe; and a data acquisition unit is in signal connection to the displacement sensor and the angle sensor for collecting distances and angle data;

the device is configured to perform a method for real-time monitoring the movement trajectory of mine roof strata, wherein the method comprises the following steps:

step 1, drilling a hole in a roof strata of a roadway or a working face to form a monitoring borehole;

step 2, pushing the sequentially connected support pipes and the connecting pipes into the monitoring borehole, and the hole sealing ring is attached to the supporting pipes and an inner wall of the monitoring borehole;

step 3, injecting grout from the grouting unit into the grouting main pipe and the grouting branch pipe, the grout flows to the supporting pipes, the inner wall of the monitoring borehole, and a space between two the hole sealing rings; after the grouting is completed and before the grout solidifies, removing the grouting main pipe from the monitoring borehole;

step 4, after the grout solidifies, collecting, by the data acquisition unit, a distance data measured by the displacement sensor and an angle data measured by the angle sensor in real time, and then obtaining a horizontal position and a vertical position of any of supporting pipes in real-time, and depicting the movement trajectory of roof strata based on the horizontal position and the vertical position of each of supporting pipes in real-time;

a calculation formula for the horizontal position $X_n$ of any of supporting pipes is:

$$X_n = I\cos\alpha_1 + d_1 + I\cos\alpha_2 + d_2 \ \ldots \ + d_{(n-1)} + \frac{1}{2}I\cos\alpha_n;$$

in the calculation formula:

l—a length of the supporting pipe, in cm;

$\alpha_1$—an angle of a first supporting pipe measured by the angle sensor, in degrees;

$\alpha_2$—an angle of a second supporting pipe measured by the angle sensor, in degrees;

$\alpha_n$—an angle of a nth supporting pipe measured by the angle sensor, in degrees;

$d_1$—a projection value of a distance between the first supporting pipe and the second supporting pipe in a X direction measured by the displacement sensor, in cm;

$d_2$—a projection value of a distance between the second supporting pipe and a third supporting pipe in the X direction measured by the displacement sensor, in cm;

$d_{(n-1)}$—a projection value of the distance between a (n−1)th supporting pipe and the nth supporting pipe measured by the displacement sensor in the X direction, in cm;

a calculation formula for a vertical position of any of supporting pipes is:

$$Y_n = I\sin\alpha_1 + h_1 + I\sin\alpha_2 + h_2 \ \ldots \ + h_{(n-1)} + \frac{1}{2}I\sin\alpha_n;$$

l—a length of supporting pipe, in cm;

$\alpha_1$—an angle of the first supporting pipe measured by the angle sensor, in degrees;

$\alpha_2$—an angle of the second supporting pipe measured by the angle sensor, in degrees;

$\alpha_n$—an angle of the nth supporting pipe measured by the angle sensor, in degrees;

$h_1$—a projection value of a distance between the first supporting pipe and the second supporting pipe in a Y direction measured by the displacement sensor, in cm;

$h_2$—a projection value of a distance between the second supporting pipe and the third supporting pipe in the Y direction measured by the displacement sensor, in cm;

$h_{(n-1)}$—a projection value of a distance between a (n−1)th supporting pipe and the nth supporting pipe in the Y direction measured by the displacement sensor, in cm.

2. The device for real-time monitoring the movement trajectory of mine roof strata according to claim 1, wherein the displacement sensor uses a draw-wire displacement sensor, at least two of the draw-wire displacement sensors are arranged between adjacent supporting pipes, a main body end of the draw-wire displacement sensor is connected to a head end of one of adjacent supporting pipes, and a rope end of the draw-wire displacement sensor is connected to a tail end of the other of adjacent supporting pipes.

3. The device for real-time monitoring the movement trajectory of mine roof strata according to claim 2, wherein two draw-wire displacement sensors are arranged between two adjacent supporting pipes;

a main body end of one of the two draw-wire displacement sensors is connected to an axis position of the head end of one of the two adjacent supporting pipes, and the rope end of the rope displacement sensor is connected to an axis position of the tail end of the other of the two adjacent supporting pipes;

an main body end of an other of the two rope displacement sensors is connected to an upper edge position of the head end of one of the two adjacent supporting pipes, and the rope end of the other of the rope displacement sensors is connected to the upper edge position of the tail end of the other of the two adjacent supporting pipes.

4. The device for real-time monitoring the movement trajectory of mine roof strata according to claim 1, wherein the grouting branch pipe is connected to the supporting pipes through a buckle, and the buckle capable of disengaging from the supporting pipes under an external force.

5. The device for real-time monitoring the movement trajectory of mine roof strata according to claim 1, wherein the hole sealing ring is made of soft material.

* * * * *